US007553270B2

(12) United States Patent
Rasmussen

(10) Patent No.: US 7,553,270 B2
(45) Date of Patent: Jun. 30, 2009

(54) PAGE INDICATOR TAB AND METHOD FOR MAKING SUCH A PAGE INDICATOR TAB

(76) Inventor: Leif Normann Rasmussen, Mølleparken 24, Børkop (DK) 7080

( * ) Notice: Subject to any disclaimer, the term of this patent is extended or adjusted under 35 U.S.C. 154(b) by 7 days.

(21) Appl. No.: 10/592,887

(22) PCT Filed: Mar. 14, 2005

(86) PCT No.: PCT/DK2005/000172

§ 371 (c)(1),
(2), (4) Date: Oct. 6, 2006

(87) PCT Pub. No.: WO2005/087457

PCT Pub. Date: Sep. 22, 2005

(65) Prior Publication Data

US 2007/0275841 A1 Nov. 29, 2007

(30) Foreign Application Priority Data

Mar. 15, 2004 (DK) ..... 2004 00417

(51) Int. Cl.
*B31B 1/14* (2006.01)
*B42F 21/02* (2006.01)

(52) U.S. Cl. ..... 493/356; 283/36; 283/39; 493/405; 40/360

(58) Field of Classification Search ..... 493/356, 493/352, 395, 405; 283/36–42; 40/360, 40/641; *B26F 1/12, 1/36; B42F 21/02*
See application file for complete search history.

(56) References Cited

U.S. PATENT DOCUMENTS 766,905 A * 8/1904 Ruth ..... 493/356
768,484 A * 8/1904 Ruth ..... 493/356
803,709 A 11/1905 Perrine
1,229,213 A 6/1917 Bernard
1,324,103 A * 12/1919 Cone ..... 493/356

(Continued)

FOREIGN PATENT DOCUMENTS

BE 1012245 8/2000

(Continued)

OTHER PUBLICATIONS

Machine translation of detailed description for JP 2002-205482 from JPO website, http://www4.ipdl.inpit.go.jp/Tokujitu/tjsogodbenk.ipdl, May 8, 2008.*

*Primary Examiner*—Stephen F Gerrity
(74) *Attorney, Agent, or Firm*—James Creighton Wray; Meera P. Narasimhan

(57) ABSTRACT

A page indicator tab (1) may be provided by cutting out a tongue-like section in parallel with free side edge (2) of a paper page. The section (1) is provided at a predetermined distance from the side edge (2), thus providing a remaining strip (3) between the section (1) and the side edge (2). The section (1) is folded along an oblique line (5) in relation to the side edge (2) and then pushed through a slit (6) already formed between the section (1) and the strip (3). The section (1) is now held in place by the counteracting forces from a base part (4) of the section (1) and the strip (3).

3 Claims, 2 Drawing Sheets

U.S. PATENT DOCUMENTS

| | | | | | |
|---|---|---|---|---|---|
| 1,324,144 | A | * | 12/1919 | Cone | 493/356 |
| 1,490,437 | A | * | 4/1924 | Sparks | 493/356 |
| 2,300,623 | A | | 11/1942 | Hornung | |
| 2,823,784 | A | | 2/1958 | Ambrose | |
| 3,561,147 | A | | 2/1971 | Valencia | |
| 4,184,699 | A | * | 1/1980 | Lowe, Jr. | 281/41 |
| 5,024,643 | A | * | 6/1991 | Kastner | 493/351 |
| 5,447,402 | A | * | 9/1995 | Kobayashi | 412/33 |
| 5,639,124 | A | | 6/1997 | Jung | |
| 6,328,338 | B1 | | 12/2001 | Sherman et al. | |
| 6,383,125 | B1 | | 5/2002 | Schwarz | |
| 2006/0076771 | A1 | * | 4/2006 | Schafer | 283/36 |

FOREIGN PATENT DOCUMENTS

| | | | | |
|---|---|---|---|---|
| CH | 20786 | | | 12/1899 |
| DE | 2803385 | | | 8/1979 |
| FR | 551183 | | | 3/1923 |
| GB | 654044 | | | 6/1951 |
| GB | 2198692 | | | 6/1988 |
| JP | 7/314974 | | | 12/1995 |
| JP | 2002-205482 | A | * | 7/2002 |
| JP | 2002/225480 | | | 8/2002 |
| JP | 2003/266983 | | | 9/2003 |
| WO | WO 99/66143 | | | 12/1999 |

* cited by examiner

PAGE INDICATOR TAB AND METHOD FOR MAKING SUCH A PAGE INDICATOR TAB

This application claims the benefit of Danish Application No. PA 2004 00417 filed March 15, 2004 and PCT/DK2005/000172 filed March 14, 2005, which are hereby incorporated by reference in their entirety.

BACKGROUND OF THE INVENTION

The invention concerns a method for making an indicator tab on a paper page. The indicator tab is cut out as a tongue-like section extending along one free side edge of the page, and the section is subsequently folded transversely so as to extend beyond the side edge of the page. The part of the section extending beyond the side edge then forms the indicator tab for marking a particular page in a document comprising the page concerned.

The invention also concerns a tool for performing the method according to the invention as well as a page indicator tab and a page provided with the indicator tab produced by the method.

A prior art indicator tab is disclosed in U.S. Pat. No. 6,383,125 B1. This tab is cut out along two sides while a third free side is a part of the free side edge of the paper page. The folding is provided along an oblique line in relation to the side edge of the paper. While the document is closed, the tab projecting out from the side of the page will stay in place. However, when the leaves of the document are turned, the inherent elasticity of the paper will sometimes cause the tab to rise up and tend to return to its original un-folded position. A slightly different indicator tab according to the same principle is disclosed in U.S. Pat. No. 4,184,699 and in JP 7314974A.

U.S. Pat. No. 5,639,124 discloses a page indicator tab cut out a tongue-like section which is spaced apart from the adjacent free side edge of the paper page. The tongue-like section extends transversely to this side edge and away from the side edge with its fixed end, the base part, disposed at the side of the section closest to the side edge of the paper. The section is folded back over the strip separating the section from the free side edge, and the section is then inserted through a separate slit provided between the base part and the free side edge of the paper. This indicator tab necessitates forming a separate slit apart from the tongue-like section. Furthermore, since the folding of the section occurs in parallel with the slit in which it is to be inserted, there is a risk that the tab may pull back through the slit due to the elasticity of the paper. A similar index tab is disclosed in GB 2198692A.

SUMMMARY OF THE INVENTION

The method according to the invention is peculiar in that the section is cut out spaced apart from the side edge of the page so that a strip continuous with the page is separating one cut side of the section from the side edge of the paper. The section is folded transversely to the side edge of the page on a first side of the strip and the page, and the section is then inserted in a slit between the cut side of the section and the strip so as to appear on a second side of the strip opposite the first side of the strip.

A page indicator tab produced by the method according to the invention is peculiar in that the section is cut out spaced apart from the adjacent side edge of the page so that a strip separates a cut side of the section and the adjacent side edge, and that the section is inserted between the strip and the part of the section close to the base of the tongue.

Also, the page provided with in indicator tab by the inventive method is peculiar in that the section is cut out spaced apart from the adjacent side edge of the page so that a strip separates a cut side of the section and the adjacent side edge, and that the section is inserted between the strip and the part of the section close to the base of the tongue.

A functional slit is thus formed between a side of the cut tongue-like section and a side of the strip separating the section from the free side edge of the paper page. The base part of the section, i.e. the part of the section close to the connection to the page, is thus folded obliquely in relation to the slit through which the tab is inserted. The effect of pull-back tendency due to the elasticity of the material is thus reduced since the pulling forces are acting obliquely and not in line with the direction of insertion of the tab into the slit. The inserted end of the tab is held in place by counteracting forces provided by the base part of the cut out section on the one hand and the elasticity of the fold on the other hand. Relatively speaking, the tab is thus retained between an "upper"side of the base part of the tongue-like section and the "lower"side of the adjacent strip of the page separating the section from the free side edge of the page. The method is also simple in that no extra slit is to be made for locking the tab between the incorrect positions.

A simple tool for manually performing the method according to the invention is peculiar in that the tool includes two mutually movable members, where a first member is provided with a cutting edge forming a largely tongue-like contour and the second member is adapted for receiving the cutting edge. The tool may be provided in various embodiments, preferably as a pocket-sized item that may e.g. a part of a key ring.

In one aspect of the tool according to the invention, the second member may be provided with a slot matching the contour of the cutting edge, the slot just being slightly wider than the projecting cutting edge so as to receive the edge in the slot.

Alternatively, the tool may be configured with its second member provided with a hole with a shape so as to receive the cutting edge in the hole immediately within the inner edges of the hole. The cutting action is thus provided between the edge and the surrounding edges of the hole on the second member.

In a further aspect of the inventive tool, the cutting edge can be made as a perforating tool for producing a variety of folds along the sides of the tongue-like section to be released and folded. The tongue-like section is subsequently released by breaking the connections between the thus formed holes.

In a further aspect of the inventive tool, the cutting edge is composed of at least two cutting edges for cutting out the tongue-like section free except for at least one narrow bridge. In this configuration, the tool does not release the tongue-like section completely but leaves at least one bridge of a paper connecting the section with the surrounding paper page. This may be advantageous for the sake of avoiding deformation of the section, or if release of the section is not desired immediately.

The tool may have to members that are pivotably joined, thus forming a pair of jaws.

In order to secure correct positioning of the section in relation to the free side edge of the paper, the second member may be provided with a stop for a free edge of a page, the stop being disposed with a determined spacing from the cutting edge.

BRIEF DESCRIPTION OF THE DRAWINGS

Embodiment examples will now be described with reference to the accompanying drawings, where.

DETAILED DESCRIPTION OF THE PREFERRED EMBODIMENTS

Figure 1:
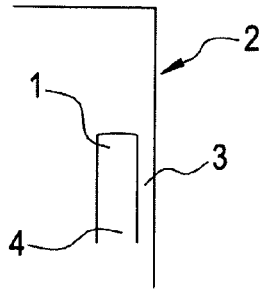
FIGS. 1-3 show three different steps in an embodiment of a method according to the invention, looking down upon a free side edge of a paper page.
Figure 2:
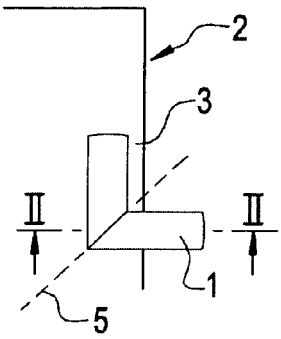

A page indicator tab according to the invention may be produced as shown on FIGS. 1-5. FIG. 1 shows part of a paper page where a tongue-like section 1 is punched or cut out close to the side edge 2 of the page in such a way that the section 1 extends along and approximately in parallel with the side edge 2. The section 1 is established with a predetermined spacing relative to the side edge 2, leaving a strip 3 of the page between the edge 2 and the section 1. After cutting, the section 1 is still continuous with the page at one end, as this end or side of the section is not cut. This un-cut end is called the base part and denoted 4.

Figure 4:
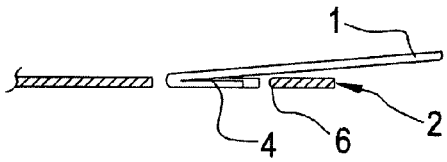
FIGS. 4-5 show the same as FIGS. 2 and 3, respectively, but as sections on the lines II-II and III-III, respectively.

In the second step in an embodiment of the method according to the invention, cf. FIGS. 1 and 4, the section 1 is folded upwards in relation to the plane of the drawing, the folding line 5 extending at an oblique angle in relation to the edge 2. The angle is preferably about 45° in relation to the side edge 2. The folding is made at the base part 4 so as to form a projecting flap 1, which is as long as possible, extending beyond the side edge 2 of the paper.

Figure 3:
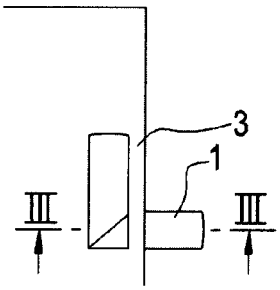
Figure 5:
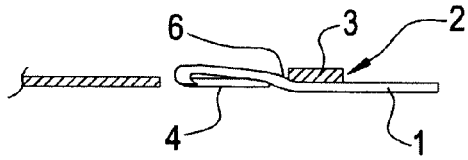
Figure 6A:
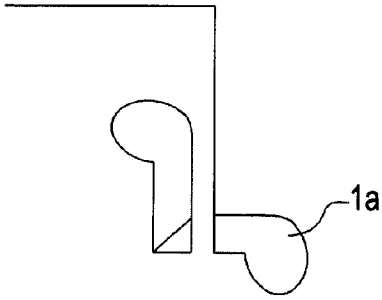
FIGS. 6*a*-6*e* show five different embodiments of a page indicator tab according to the invention.
Figure 6B:
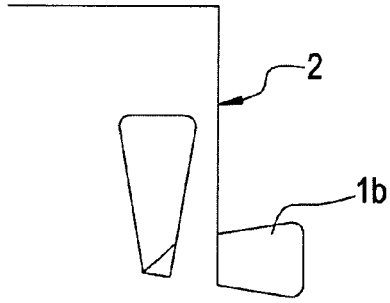
Figure 6C:
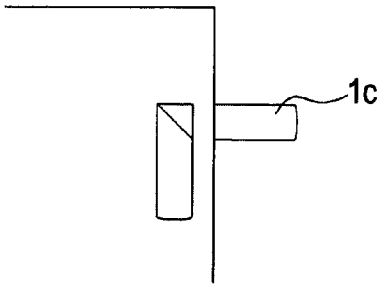
Figure 6D:
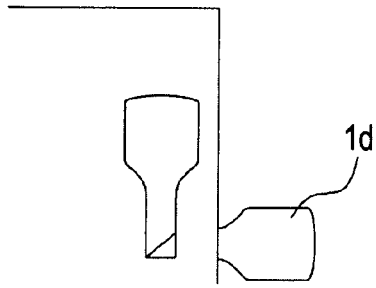
Figure 6E:
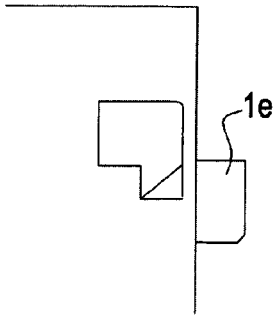

In the third step, cf. FIGS. 3 and 5, the free end of the section 1 is inserted through a slit 6 appearing between the unfolded part of the base part 4 and the inner side of the strip 3. The section or flap 1 is now forming a page indicator tab projecting outside the page and beyond the side edge 2.

The page indicator tab is now securely positioned between the base part 4 and the strip 3, as the elements 3, 4 provide counteracting forces. Furthermore, the oblique position of the folding line 5 and the associated fold directs the pull-back effect of the inherent elasticity of the page material obliquely and not aligned with the direction of insertion of the section 1 into the slit 6, thus further deterring a returning of the section 1 to its original unengaged position.

The indicator tab or index tab thus formed may form an indication marker by itself or may be applied numbers, letters or colour markings for indicating and remembering the particular page.

FIGS. 6*a*-6*e* show five different shapes of flaps or sections denoted 1*a*-1*e* that may be used for the page indicator tab according to the invention. The version designated 1*a* and 1*d* have enlarged end portions for providing a larger marking or writing area. The version named 1*b* is also enlarged at the end, but with non-parallel sides; the section 1*b* as a whole is, however, cut out as a section largely in parallel with side edge 2. The embodiment designated 1*c* is only an inversed version of that of FIG. 3. The version designated 1*e* optimises the area projecting from the edge 2 without taking up excessive space outside the page.

Figure 7:
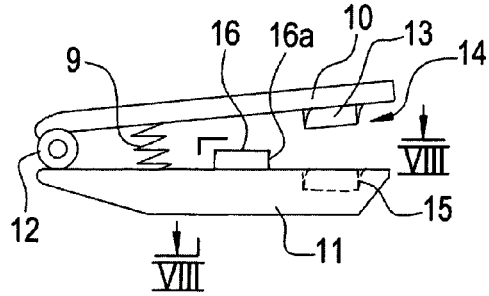
FIG. 7 shows a side view of an embodiment of a tool for performing the method according to the invention.
Figure 8:
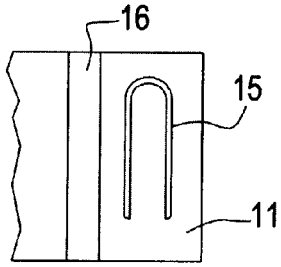
FIG. 8 shows a section on the line VIII-VIII on FIG. 7.

A first embodiment of the tool according to the invention shown on FIGS. 7 and 8 comprises two plier-like members 10 and 11 connected along one side with a hinge-like connection 12. The members 10, 12 are biased towards their open position by a spring 9. The upper member 10 is provided with a perforating tool 13 having a sharp edge or rim 14, the edge 14 being having the shape of the section to the cut out from the paper page. The lower member 11 is provided with a slot 15 with a slightly greater width than the edge 14 and with a contour which is complimentary to the outline of the edge 14. A raised portion 16 with an edge 16*a* facing the slot 15 is provided in the lower part 11 as a stop for correctly positioning the free side edge of a page, thus limiting the with of strip 3 eventually to be produced.

The tool is applied by inserting the free side edge of a page between the members 10, 11 until the free side edge 2 abuts on the edge 16*a* of the raised portion 16. The width of the eventually formed strip 3 is thus determined. Then the members 10, 11 are moved together by using the fingers, thus perforating the page while shaping the tongue-like section 1 depicted on FIG. 1. The steps on shown on FIGS. 2-5 may then be performed manually.

Figure 9:
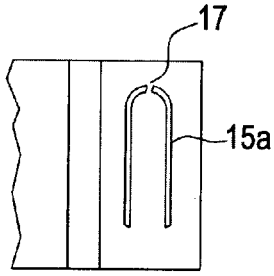
FIG. 9 shows a second embodiment of a tool according to the invention as a detail corresponding to FIG. 8.

Various embodiments of the tool according to the invention may be envisioned. In a second embodiment of the tool shown on FIG. 9, the tool members 13, 15 may have the shape as shown on FIG. 9 where the slot 15*a* is discontinued at one end, thus forming a bridge 17 in the tool as well as in the section produced by the tool in the paper page. Variations of this embodiment may include two or more bridges 17 placed with even or uneven spacing on the tool members. This embodiment may leave the section 1 temporarily in a controlled position in the plane of the page before folding.

Figure 10:
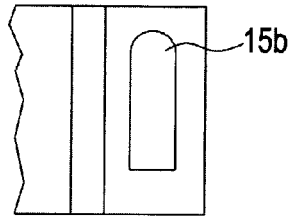
FIGS. 10-11 show two different views of details of a third embodiment of a tool according to the invention and corresponding to views of FIGS. 8 and 7, respectively.
Figure 11:
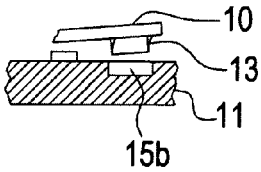

A third embodiment of the tool is shown on FIGS. 10 and 11, where the upper member 10 with the tool part 13 is unchanged, but where the lower member 11 is provided with a recess or cut-out 15*b*. The cutting action is thus provided between the outer side of the tool 13 and the inner, vertical side of the cut-out 15*b*.

Figure 12:
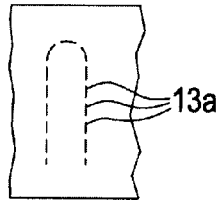
FIG. 12 shows a detail of a fourth embodiment of a tool according to the invention.

In a fourth embodiment according to the invention, each tool member may be constituted by a row of points and holes as outlined on FIG. 12. The tool 13*a* is thus provided as a number of needles or other pointed members 13*a* distributed along a contour of the tongue-like section 1, while the not shown opposite tool member is provided with corresponding holes. In this embodiment, the tool provides a perforation of the paper, in which case the indicated tab is just prepared, but not released and established completely at first.

Other embodiments of the tool according to the invention are possible. For example, the mutual movement of the member 10, 11 may be provided as a translational movement instead of a pivoting movement. This would require guides or the like to keep the members in parallel during the movement. Also, the tool of FIGS. 7 and 8 may be provided with a handle like in a pair of pliers or scissors for applying greater punching force. In a still further embodiment, the tool may be provided with exchangeable tool members 13, 15 for changing the shape of the tongue-like section 1. Also, the tool may be provided with several members 13, 15, for example as a desk top model with members 13, 15 with differently configured tools mounted in opposite directions or in star shape.

Figure 13:
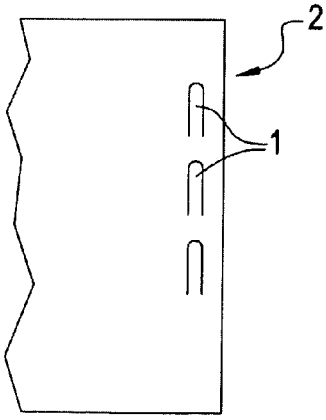
FIG. 13 shows part of a paper page where the pre-formed tongue-like sections intended for making an indicated tab according to the invention.
Figure 14A:
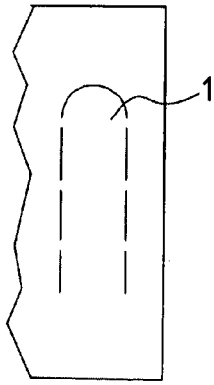
FIGS. 14*a*-14*b* show two different embodiments of pre-formed tongue-like sections performing an indicator tab according to the invention.
Figure 14B:
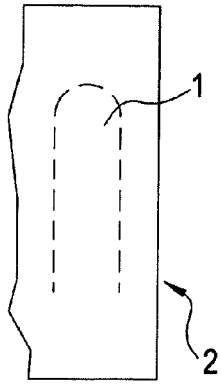

In a further aspect of the invention, a page may be provided with pre-formed tongue-like sections 1, for example by perforation as shown on FIGS. 14*a* and 14*b*; the sections may then be released and folded by the reader of the document when needed. A page provided with such sections may also be provided with a number of pre-formed would-be indicator tabs as shown on FIG. 13, the tabs being uniform, as depicted, or with mutually differing shapes on the same page.

The invention claimed is:

1. A method for making an indicator tab on a paper page with at least one free side edge, the method including cutting out a tongue-like section extending along the side edge of the page while continuous with the page at one end of the section, where the section is folded transversely to and extending beyond the side edge of the page so as to form an indicator tab extending beyond the side edge, characterised in that the section is cut out spaced apart from the side edge of the page so that a strip continuous with the page is separating one cut side of the section from the side edge of the paper, that the section is folded transversely to the side edge of the page on a first side of the strip and the page, and that the section is inserted in a slit between the cut side of the section and the strip so as to appear on a second side of the strip opposite the first side of the strip, and so that the section is inserted between the strip and the part of the section close to the base of the tongue-like section.

2. A page indicator tab provided at the edge of a paper page by the method according to claim 1, the tab provided as a tongue-like section partly cut out from the paper page along an adjacent side edge of the page so as to be continuous with the page at the base of the tongue and folded to project beyond the side edge of the page, characterised in that the section is cut out spaced apart from the adjacent side edge of the page so that a strip separates a cut side of the section and the adjacent side edge, and that the section is inserted between the strip and the part of the section close to the base of the tongue.

3. A page provided with an indicator tab by the method according to claim 1, the tab provided as a tongue-like section partly cut out from the paper page along an adjacent side edge of the page so as to be continuous with the page at the base of the tongue and folded to project beyond the side edge of the page, characterised in that the section is cut out spaced apart from the adjacent side edge of the page so that a strip separates a cut side of the section and the adjacent side edge, and that the section is inserted between the strip and the part of the section close to the base of the tongue.

* * * * *